United States Patent [19]

Conklin

[11] 4,274,034

[45] Jun. 16, 1981

[54] GLOW PLUG DRIVER

[75] Inventor: Charles W. Conklin, Huntington Beach, Calif.

[73] Assignee: C&D Enterprises, Huntington Beach, Calif.

[21] Appl. No.: 84,652

[22] Filed: Oct. 15, 1979

[51] Int. Cl.[3] ..... H05B 37/00; H05B 39/00; H05B 41/14

[52] U.S. Cl. ..... 315/240; 315/209 T; 315/209 CD; 315/307; 315/241 R; 123/653; 307/246; 307/264; 307/296 R

[58] Field of Search ..... 315/308, 307, 306, 240, 315/241, 205, 209 R, 209 T, 209 SC, 209 CD; 307/246, 296, 297, 264; 123/653, 654, 656

[56] References Cited

U.S. PATENT DOCUMENTS

| | | | |
|---|---|---|---|
| 3,317,820 | 5/1967 | Nylander | 307/297 |
| 3,531,712 | 9/1970 | Cecchini | 307/297 |
| 3,597,652 | 8/1971 | Gates, Jr. | 307/297 |
| 3,657,572 | 4/1972 | Millman | 307/297 |
| 3,714,512 | 1/1973 | Grabowski | 307/297 |
| 4,005,317 | 1/1977 | Hinrichs | 307/246 |

*Primary Examiner*—Saxfield Chatmon, Jr.
*Attorney, Agent, or Firm*—Gordon L. Peterson

[57] ABSTRACT

A glow plug driver adapted to be coupled to a power supply and a glow plug comprising first and second conductive leads for coupling the glow plug to the power supply and an electronic switch in the first lead having conductive and nonconductive states so that pulses of electrical energy can be supplied to the glow plug. A resistor and a capacitor are coupled between the leads in parallel with the glow plug so that the capacitor can charge when the electronic switch is in the conductive state and discharge when the electronic switch is in the nonconductive state. A timer is used to place the electronic switch in the conductive state for a predetermined amount of time. The timer is in turn controlled by a transistor having its base coupled to a junction between the resistor and the capacitor.

11 Claims, 3 Drawing Figures

Fig. 1
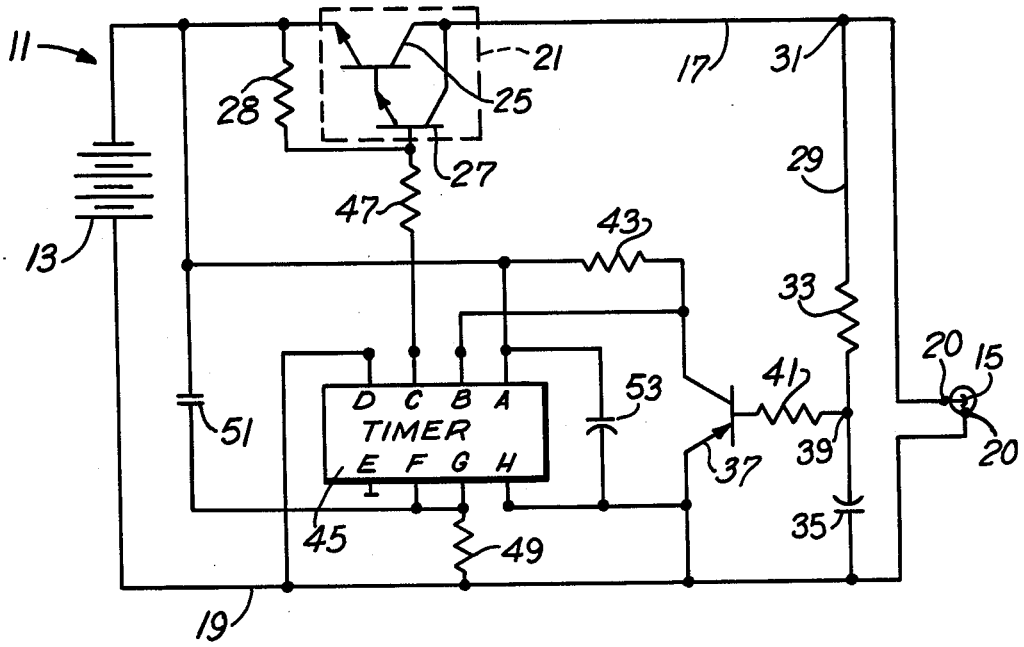
Fig. 2
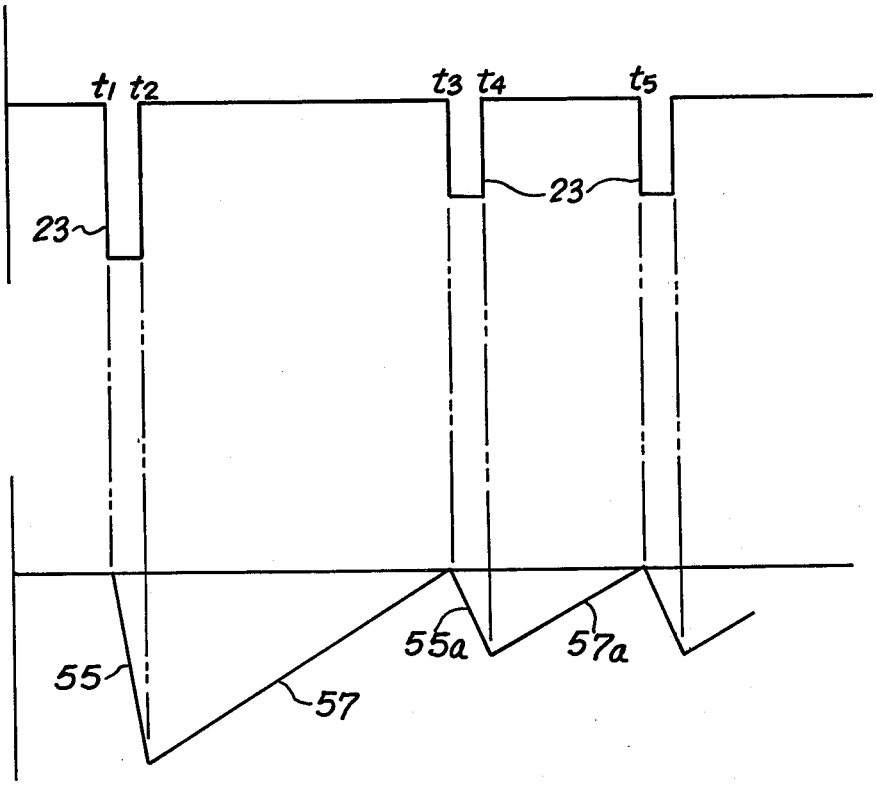
Fig. 3

GLOW PLUG DRIVER

BACKGROUND OF THE INVENTION

Various small engines, such as model airplane engines, are started manually utilizing a glow plug. The glow plug heats the fuel-air mixture so that the fuel-air mixture can ignite to initiate engine operation.

The glow plug is a resistance element which is heated electrically by a glow plug driver. The resistance of the glow plug varies with temperature. During the engine starting operation, the temperature of the glow plug varies due to, for example, the cooling of the glow plug by the fuel. When the glow plug is cooled, its resistance drops, and it tends to draw more current. Ideally, the glow plug driver should provide more power to the glow plug as the glow plug cools.

Prior art glow plug drivers have not been particularly efficient in applying full battery voltage across the glow plug. Consequently, relatively large batteries have been required. Prior art glow plug drivers are also relatively large, and the output is sensitive to variations in values of many of the circuit components.

SUMMARY OF THE INVENTION

This invention provides a small, lightweight, efficient glow plug driver which requires only a relatively small battery and which can power various kinds of glow plugs, such as 1.5 volt, 2 volt and racing glow plugs without adjustment. The glow plug driver of this invention automatically compensates for variations in the resistance of the glow plug and in battery voltage, and the output of the glow plug driver is independent of most of the values of the components of the driver. The glow plug driver can be a small hand-held unit with internal batteries.

The glow plug driver of this invention provides pulses of electrical energy to the glow plug. The average power to the glow plug is automatically adjusted by varying the interval between pulses. Thus, when the engine to be started is cold or flooded, the glow plug driver automatically reduces the interval between pulses to increase the average power, and this is accomplished in a novel and unique manner.

The glow plug is ordinarily provided as a part of the engine to be started, and the power supply, such as a battery, is optionally a part of the glow plug driver. The glow plug driver includes first and second conductive leads for coupling the glow plug to the power supply and electronic switch means in the first lead having conductive and nonconductive states. By turning the electronic switch means on and off, pulses of electrical energy can be supplied to the glow plug from the power supply.

To control the electronic switch means, a conductive lead or path is coupled to the first lead to form a junction between the electronic switch means and the glow plug. The conductive path is also coupled to the second lead. With this arrangement, the voltage at the junction, when power is being supplied to the glow plug, varies with the resistance of the glow plug.

A resistor and a capacitor are provided in the conductive path. This enables the capacitor to charge when the electronic switch means is conducting and to discharge through the resistor when the electronic switch means is not conducting. The charging rate of the capacitor is a function of the voltage at the junction, and the voltage at the junction is in turn a function of the resistance of the glow plug. Accordingly, the charging rate of the capacitor varies with the resistance of the glow plug.

This invention utilizes this variable charging rate to provide automatic compensation for a cold or flooded engine condition. To accomplish this, first means is coupled to the capacitor with the first means being responsive to the capacitor discharging to a predetermined level for providing a signal which is used to control the electronic switch means. The discharge rate of the capacitor is constant and so the time required for the capacitor to discharge to the predetermined level depends upon the amount of charge on the capacitor. Accordingly, less time is required for the capacitor to discharge from a relatively low charge level than from a relatively high level.

Although the predetermined level can be established in different ways, such as by utilizing a comparator with a voltage reference, it is preferred to use an electronic switch, such as a transistor, for this purpose. The transistor not only provides a reference level to which the capacitor can discharge, but also provides the signal which is used for controlling the electronic switch means.

Switch control means responds to the signal to place the electronic switch means in the conductive state. Although various arrangements are possible, preferably the switch control means includes a timer which maintains the electronic switch means in the conductive state for a fixed predetermined length of time. The interval between each time the electronic switch means is made conductive depends upon the time required to discharge the capacitor, and consequently, the average power to the glow plug is automatically adjusted.

With this construction, substantially full battery voltage can be applied to the glow plug. About the only losses are the internal battery resistance and very minor losses in the electronic switch. Consequently, only a small battery, such as a 4.8 volt rechargeable battery is required as the power supply for the glow plug driver, and a battery voltage range of 4 to 6 volts is preferred.

Another important feature of the invention is that the average power provided by the glow plug driver is essentially independent of all of the components of the circuit, except for battery voltage and the predetermined level to which the capacitor is permitted to discharge. Specifically, the charging rate of the capacitor depends only on battery voltage and the glow plug, the latter not being part of the glow plug driver. The discharge rate of the capacitor is determined by the predetermined level to which the capacitor is permitted to discharge. The ratio of the discharge rate to the charge rate of the capacitor determines the average power delivered to the glow plug and, accordingly, the average power is independent of the values of the other components of the circuit.

The invention, together with further features and advantages thereof, may best be understood by reference to the following description taken in connection with the accompanying illustrative drawing.

BRIEF DESCRIPTION OF THE DRAWING

FIG. 1 is a circuit diagram of a preferred form of glow plug driver with the glow plug driver being coupled to a glow plug and a battery.

FIG. 2 is a plot of the voltage pulses applied to the glow plug.

FIG. 3 is a plot showing the charging and discharging of the capacitor.

DESCRIPTION OF THE PREFERRED EMBODIMENT

FIG. 1 shows a glow plug driver 11 coupled to a battery 13 and to a glow plug 15. The battery may, if desired, be furnished with, and form a portion of, the glow plug driver. The battery 13 in the embodiment illustrated is a 4.8-volt rechargeable nickel cadmium battery, although other batteries and dc power supplies can be used.

The glow plug 15 is not part of the glow plug driver 11. Rather, the glow plug 15 is part of the engine to be started and can be releasably coupled to the glow plug driver 11. The glow plug 15 is adapted to be placed in a fuel-air mixture within the engine combustion chamber where the temperature and resistance of the glow plug can vary with, for example, engine starting conditions.

The glow plug driver 11 includes conductive leads 17 and 19 coupled to the negative and positive terminals, respectively, of the battery 13 and coupled to the glow plug 15 by terminals 20. An electronic switch 21 having conductive and nonconductive states is provided in the lead 17. By turning the electronic switch 21 off and on, pulses 23 (FIG. 2) of electrical energy can be supplied to the glow plug 15. Although the electronic switch 21 can take different forms, in the embodiment illustrated, it includes transistors 25 and 27 coupled together as a Darlington pair. The Darlington switch is preferred because it has a high gain and low losses. A resistor 28 is coupled between the lead 17 and the base of the transistor 27.

A conductive path 29 extends from a junction 31 to the lead 19. The junction 31 is between the electronic switch 21 and the glow plug 15. A resistor 33 and a capacitor 35 are provided in series with each other in the conductive path 29 and in parallel with the glow plug 15. A switching transistor 37 has its base coupled to a junction 39 through a current limiting resistor 41. The collector of the transistor 37 is coupled through a resistor 43 to the lead 17, and the emitter of the transistor is coupled to the lead 19.

A timer 45 having eight terminals A, B, C, D, E, F, G, and H has its terminals A and B coupled to the lead 17 and to the collector of the transistor 37 on opposite sides of the resistor 43 as shown. The terminal C, which is an output terminal, is coupled to the base of the transistor 27 through a current-limiting resistor 47, and the terminal D, which is unused, is coupled to the lead 19 which is at ground potential. The terminals F and G are coupled to the lead 17 and to the terminal A through a capacitor 51 and to the lead 19 through a resistor 49. The terminal H is coupled to the lead 19, and a decoupling capacitor 53 is coupled across the terminals A and H. The capacitor 53 keeps noise from the battery 13 and the timer 45 from providing a false signal to the timer. The terminal E is not used.

The timer 45 is of standard construction and is of the type which provides either a high or a low reference level on the terminal C through the resistor 47 to the transistor 27. Specifically, the terminal C is either at essentially battery potential, e.g., −4.8 volts in the illustrated embodiment, to open the switch 21 or at ground potential, e.g., 0 volts in the illustrated embodiment, to close the switch 21. In the embodiment illustrated, the terminal B senses the turning off of the transistor 37 and, in response, the timer 45 places the terminal C at ground potential to close the switch 21. The timer 45 maintains the terminal C at ground potential for a predetermined length of time regardless of any change in state of the transistor 37. This is accomplished by the capacitor 51 and the resistor 49 in combination with the timer 45. Specifically, when the switch 21 is closed, the capacitor 51 charges at a rate controlled by the resistor 49. When the charge level on the capacitor 51 reaches a predetermined level, such as $\frac{2}{3}$ of the potential of the battery 13, this predetermined level is detected at the terminal F of the timer 45, and in response, the timer 45 places the terminals C and G at battery potential to open the switch 21 and to discharge the capacitor 51.

The timer 45 is available from a number of manufacturers, and in the preferred embodiment, the timer 45 is designated as a 555 timer. For example, the timer 45 is available from National Semiconductor of Santa Clara, Calif., as an LM 555 timer.

The operation of the glow plug driver 11 can best be understood by reference to FIGS. 2 and 3. Assuming that the electronic switch 21 has just been placed in a conductive state by the timer 45, a pulse 23 of electrical energy is transmitted on the lead 17 to the glow plug 15 from time $t_1$ to time $t_2$. The resistance of the glow plug 15 depends upon various factors, including the temperature of the glow plug. The voltage at the junction 31 varies with the resistance of the glow plug 15.

During the time that the pulse 23 is applied through the junction 31 to the glow plug 15, the capacitor 35 charges along a ramp 55. The charging rate and hence the slope of the ramp 55 depend upon the voltage at the junction 31. For example, the capacitor 35 charges from the reference level of approximately −0.7 volts to a greater negative value which may be, for example, −0.75 volts. Of course, the rate at which the capacitor 35 charges is also a function of the resistance of the resistor 33. However, because the resistance of the resistor 33 is fixed, essentially the only variable which controls the charge rate of the capacitor 35 is the voltage at the junction 31.

At time $t_2$ the switch 21 opens to terminate the first pulse 23, and the capacitor 35 begins discharging. The capacitor 35 discharges from time $t_2$ to $t_3$ along a ramp 57. The discharge rate and hence the slope of the ramp 57 depend upon the potential at the junction 39. In the embodiment illustrated, the potential at the junction 39 is fixed by the base-emitter junction voltage of the transistor 37. For example, this voltage may be approximately −0.7 volts. Because this reference level is not allowed to vary much from −0.7 volts, the discharge rate and the slope of the ramp 57 remain essentially the same each time the capacitor 35 discharges.

The time constant for the capacitor 35 and the resistor 33 is large in light of the duration of the pulses 23. Accordingly, in normal operation, the capacitor 35 operates in the essentially linear range so that the ramps 55 and 57 are essentially straight lines. The capacitor 35 in normal operation never reaches or even approaches being fully charged.

When the capacitor 35 discharges to the reference level established by the transistor 37, the transistor 37 turns off, and this provides a signal to the timer 45 which in turn places the terminal C at ground potential to again make the switch 21 conductive to initiate a second one of the pulses 23. This operation is then rapidly repeated. The transistor 37 is turned on when the capacitor 35 charges above the base-emitter voltage of the transistor.

If on the next cycle of operation for example the voltage at the junction 31 should drop, as shown in FIG. 2 by the second of the pulses 23, due to a decreased resistance of the glow plug 15, the charging rate of the capacitor 35 reduces as shown by a ramp 55*a*. Consequently, as the charging time for the capacitor 35 is of fixed duration, i.e., for the length of one pulse 23, the capacitor will be charged to a lower level at the time $t_4$ than at the time $t_2$. Thereafter, the capacitor 35 discharges along a ramp 57*a* which has essentially the same slope as the ramp 57. However, because the capacitor 35 was not charged to the same level as previously, the capacitor discharges to the reference level in a lesser amount of time. Consequently, the transistor 37 is turned off, and the timer 45 closes the switch 21 to initiate a third of the pulses 23 sooner. As a result, the interval from $t_4$ to $t_5$ is less than the interval from $t_2$ to $t_3$, and this increases the average power delivered to the glow plug 15.

It can be seen from the foregoing that the rate at which the capacitor 35 charges as reflected by the slopes of the ramps 55 and 55*a* is controlled by the voltage at the junction 31. Also, the rate at which the capacitor 35 discharges as reflected by the slope of the ramps 57 and 57*a* is a function of the reference level established by the transistor 37. The average power supplied to the glow plug 15 depends on the ratio of the discharge rate to the charge rate of the capacitor 35. With respect to circuit components of the glow plug driver 11, the average power delivered to the glow plug 15 depends only upon the voltage of the battery 13 and the reference level established by the base-emitter voltage of the transistor 37. Conversely, the average power is not dependent upon the values selected for the other circuit components of the glow plug driver 11, such as the other resistors and capacitors of the glow plug driver 11. This provides a wide latitude in selection of these other circuit components, and inexpensive components can be used because there is no need to have their values accurately known and established.

To further illustrate how one embodiment of this invention can be constructed, the resistors 28 and 47 may be 130 ohms and 68 ohms, respectively, and the resistors 43 and 49 may be 10,000 ohms and 5,600 ohms, respectively. The resistor 41 may also be 10,000 ohms, and the resistor 33 may be, for example, 430 ohms. In a preferred embodiment, the capacitors 51 and 53 each have a capacitance of 0.1 microfarad, and the capacitor 35 has a capacitance of 33 microfarads.

Although an exemplary embodiment of the invention has been shown and described, many changes, modifications and substitutions may be made by one having ordinary skill in the art without necessarily departing from the spirit and scope of this invention.

I claim:

1. A glow plug driver adapted to be coupled to a power supply and a glow plug wherein the glow plug is adapted to be placed in a fuel-air mixture where the temperature and resistance of the glow plug can vary, said glow plug driver comprising:

first and second conductive leads for coupling the glow plug to the power supply;

electronic switch means coupled to at least one of said leads and having conductive and nonconductive states whereby pulses of electrical energy can be supplied to the glow plug from the power supply when the glow plug is coupled to said leads and said electronic switch means is in said conductive state;

a conductive path coupled to the first lead to form a junction at which the voltage varies with the resistance of the glow plug when the glow plug is coupled to the first lead;

a resistor and a capacitor in said conductive path so that the capacitor can charge when the electronic switch means is in said conductive state at a rate which is a function of the voltage at said junction and discharge through said resistor when said electronic switch means is in said nonconductive state; and control means responsive to said capacitor discharging to a predetermined level to place the electronic switch means in said conductive state, said control means including means for placing said electronic switch means in said nonconductive state whereby when the glow plug is coupled to said leads the time between the pulses supplied to the glow plug varies with the resistance of the glow plug.

2. A glow plug driver as defined in claim 1 wherein the control means includes means coupled to said capacitor for preventing said capacitor from discharging substantially below said predetermined level whereby the average power provided to said junction by the power supply is essentially independent of the values of the components of the glow plug driver other than the power supply and said predetermined level.

3. A glow plug driver as defined in claim 1 wherein said control means includes timer means for placing the electronic switch means in said conductive state for a predetermined length of time.

4. A glow plug driver as defined in claim 1 wherein said junction is between said electronic switch means and the glow plug when the glow plug is coupled to said leads.

5. A glow plug driver as defined in claim 1 wherein said control means includes first means coupled to said capacitor and responsive to said capacitor discharging to a predetermined level for providing a signal, said control means including switch control means responsive to said signal to place the electronic switch means in said conductive state.

6. A glow plug driver as defined in claim 5 wherein said first means includes a transistor coupled to said conductive path between said resistor and said capacitor.

7. A glow plug driver as defined in claim 5 wherein said switch control means includes timer means responsive to said signal to place the electronic switch means in said conductive state for a predetermined length of time.

8. A glow plug driver as defined in claim 5 wherein said first means includes means coupled to said capacitor for preventing said capacitor from discharging substantially below said predetermined level, said predetermined level being greater than the potential of said second lead, said switch control means includes timer means responsive to said signal to place the electronic switch means in said conductive state for a predetermined length of time.

9. A glow plug driver as defined in claim 8 wherein said first means includes a transistor having a base and first and second terminals, said base being coupled to the conductive path between said resistor and said capacitor, said first terminal being coupled to said first lead between the electronic switch means and the power supply and said second terminal being coupled to said second lead, said electronic switch means including first and second transistors coupled together as a Darlington pair.

10. A glow plug driver adapted to be coupled to a power supply and to a glow plug to heat the glow plug, said glow plug driver comprising:

first and second conductive leads for coupling the glow plug to the power supply;

electronic switch means coupled to said first lead and having conductive and non-conductive states whereby pulses of electrical energy can be supplied through the electronic switch means;

a resistor and a capacitor coupled to at least one of said leads so that the capacitor can charge when the electronic switch means is in said conductive state and discharge through said resistor when the electronic switch means is in said non-conductive state; and control means coupled to the capacitor and the electronic switch means and responsive to the capacitor discharging to a predetermined level to place the electronic switch means in said conductive state for a predetermined period of time.

11. A glow plug driver as defined in claim 10 wherein said control means includes a transistor having a base coupled to a location between said resistor and said capacitor and said control means is coupled to the transistor and responsive to the transistor for placing the electronic switch means in said conductive state for a predetermined period of time.

* * * * *